US005477967A

United States Patent [19]

Voorhees et al.

[11] Patent Number: 5,477,967

[45] Date of Patent: Dec. 26, 1995

[54] VERTICAL FILING

[75] Inventors: Scott W. Voorhees, Woodbridge, Va.; Christopher G. Ireland, Devon, United Kingdom; Benjamin Ong Tze-Nan, Singapore, Singapore

[73] Assignee: Inventure Development Corporation, Woodbridge, Va.

[21] Appl. No.: 351,222

[22] Filed: Nov. 30, 1994

[51] Int. Cl.[6] ..... A47F 5/00

[52] U.S. Cl. ..... 211/55; 211/103; 211/88; 248/214

[58] Field of Search ..... 211/55, 45, 103, 211/113, 117, 88; 248/214

[56] References Cited

U.S. PATENT DOCUMENTS

| | | | |
|---|---|---|---|
| 3,023,907 | 3/1962 | Ross . | |
| 3,184,068 | 5/1965 | Wende | 211/103 X |
| 3,472,387 | 10/1969 | Olsen . | |
| 4,062,452 | 12/1977 | Bartholomew . | |
| 4,081,080 | 3/1978 | Rorex . | |
| 4,527,694 | 7/1985 | Bolt et al. | 211/45 X |
| 4,988,006 | 1/1991 | Lundin . | |
| 5,048,697 | 9/1991 | Payne . | |
| 5,086,934 | 2/1992 | Kelly . | |
| 5,141,115 | 8/1992 | Nicoll | 211/55 |
| 5,184,737 | 2/1993 | Hardy | 211/55 |

OTHER PUBLICATIONS

Eldon Hot® Stuff File Pocket Catalog, 1993.

*Primary Examiner*—Robert W. Gibson, Jr.
*Attorney, Agent, or Firm*—Nixon & Vanderhye

[57] ABSTRACT

A file folder assembly is easy to construct and utilize, is simple to expand, and allows a maximum number of discrete files to be stored in a minimum amount of usable space. First and second slotted shelving uprights extend generally parallel to each other and are mounted on an office panel or wall. Pairs of side brackets with mounting ears and lock projections fit within the slots, and have rod receiving openings at opposite ends. Rods, e.g. round galvanized steel rods, pass through collars formed at the ends of flexible file folders, each rod gripped by the side brackets at opposite ends, two side brackets supporting two rods and the flexible file folder extending between them. The file folder may be of polypropylene or PVC sheet material, creased at a lower portion so as to prevent papers disposed in the file folder from rising up the sides.

20 Claims, 4 Drawing Sheets

FIG.2
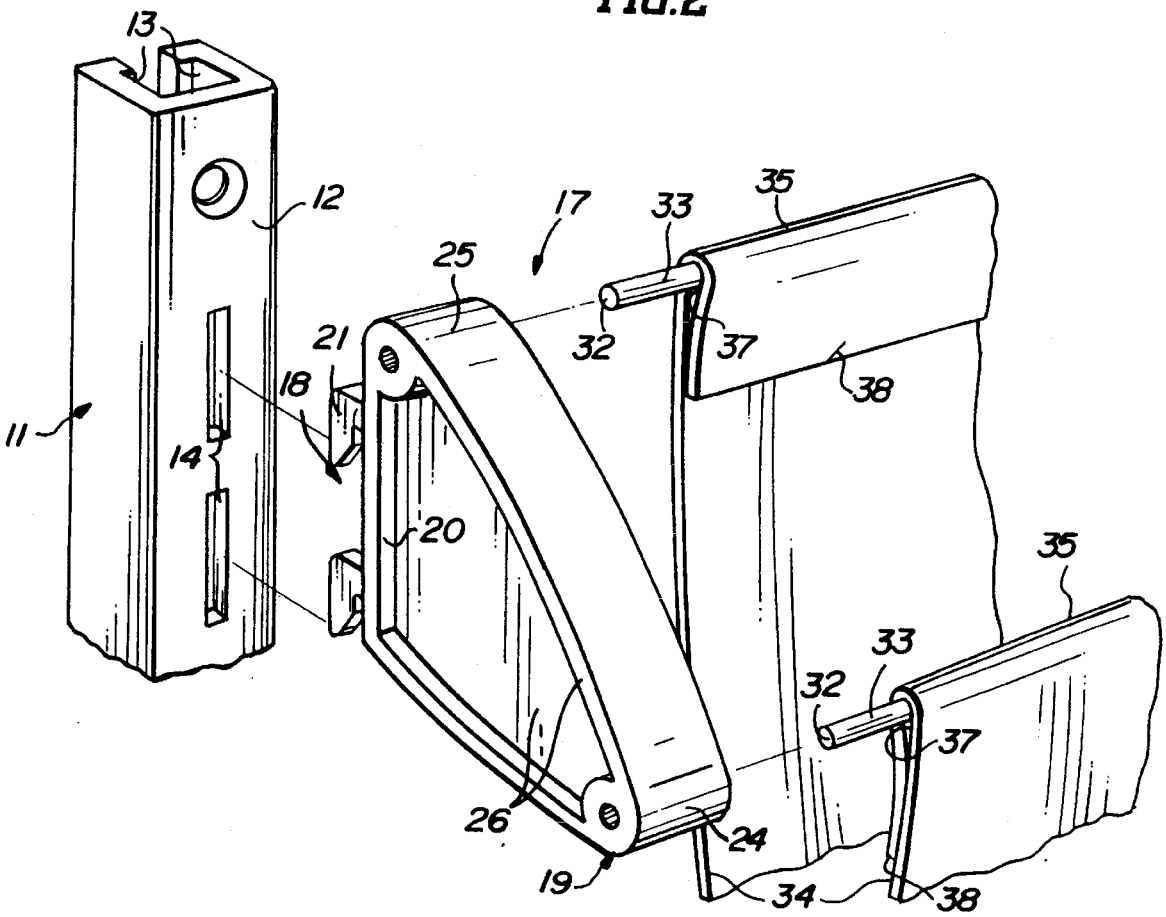
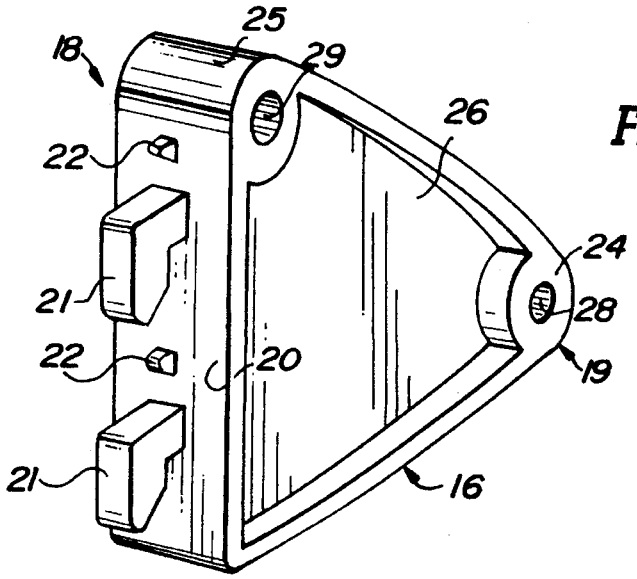
FIG. 3

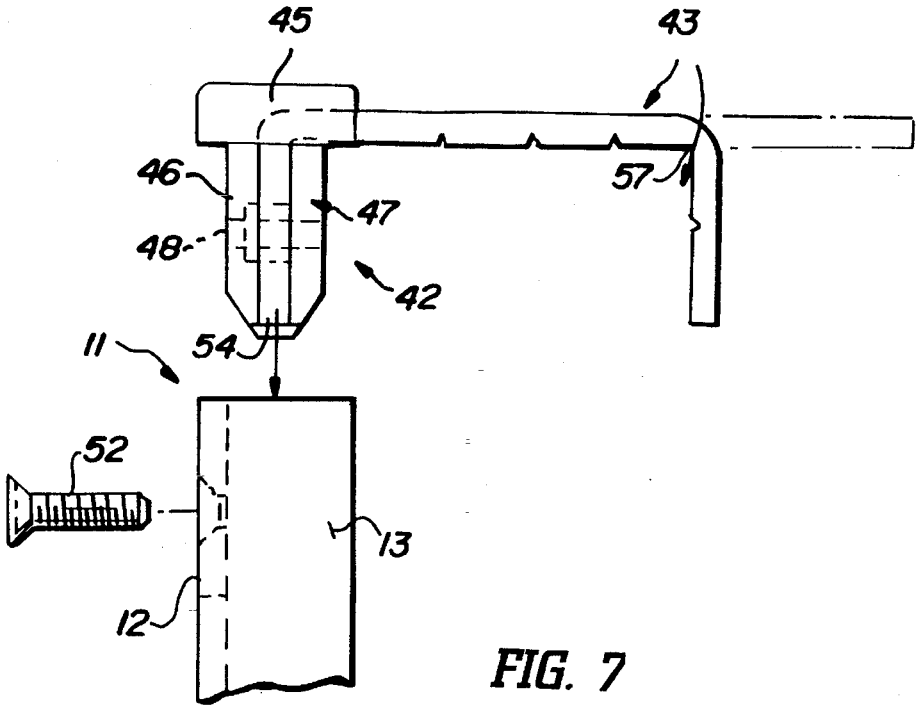
FIG. 7
FIG. 8
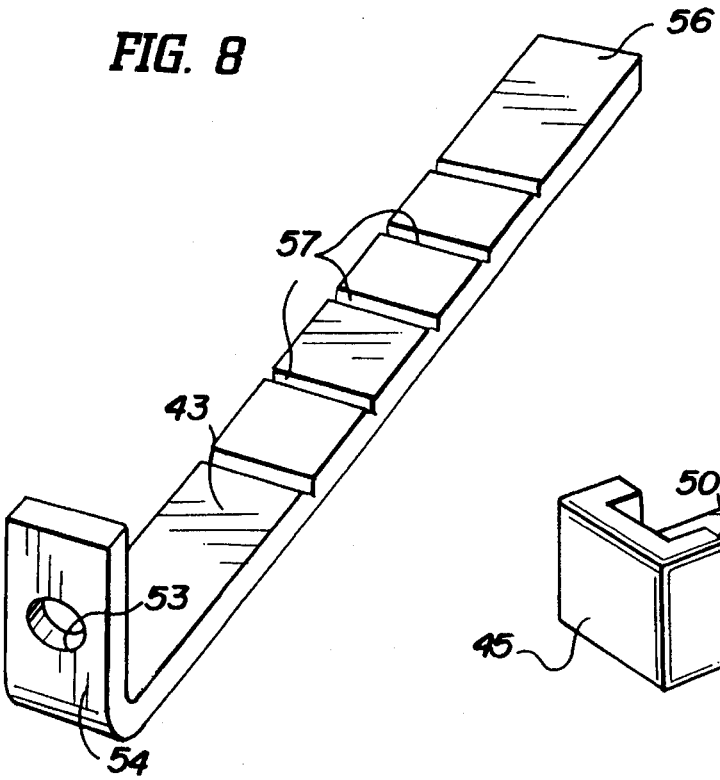
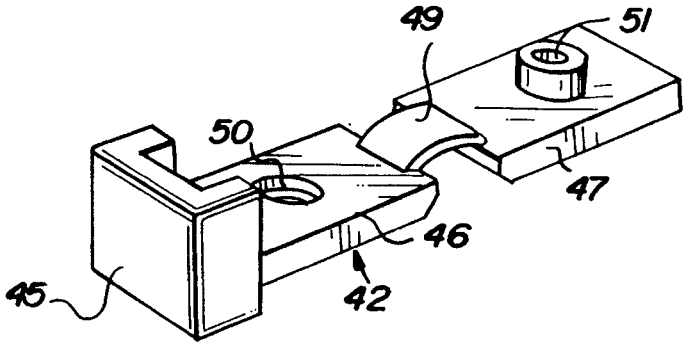
FIG. 9

VERTICAL FILING

BACKGROUND AND SUMMARY OF THE INVENTION

There are many different types of vertical filing systems for storing relatively small numbers of documents, such as shown in U.S. Pat. Nos. 4,081,080 and 3,023,907. The current commercial modifications of such systems typically use rigid plastic file pockets which are either mounted by hooks extending over office partitions, or are individually or in a predetermined series attached to a wall. While being useful for many purposes, these commercial vertical filing systems do not have the versatility that is desired in a filing system. That is it is not easy to provide for the expanded ability of an individual pocket to hold documents but rather the number of documents held by a pocket is essentially fixed due to the rigid nature thereof.

There are other proposals for filing systems which use flexible material pockets, such as shown in U.S. Pat. Nos. 5,086,934 and 4,988,006. However these systems are necessarily extended horizontally as well as being vertical, and can be difficult to expand in size, both as far as the number of pockets are concerned or the spacing between the pockets (and therefore the individual capacity of each).

According to the present invention a file folder assembly has been provided which has a number of advantages compared to prior art systems, primarily related to its versatility and flexibility of use. The file folder assembly according to the present invention either hangs on office partitions or fastens to walls. It uses conventional slotted rails to allow for adjustment of the positions of the pockets with respect to each other in a simple yet effective manner, and allows easy expansion of the number of pockets and the individual capacity of the pockets. The pockets are of flexible material and each pocket is distinct from the rest of the pockets so as to allow easy replacement and removal of an entire pocket from the system. The pockets are preferably of durable plastic material, such as polypropylene, and are preferably transparent to allow the materials mounted therein to be readily seen. In general the file folder assembly according to the present invention—and a kit for constructing the file folder assembly—is simple and inexpensive to make and utilize yet has maximum versatility and accessibility.

According to one aspect of the present invention a file folder assembly is provided comprising the following elements: First and second slotted shelving uprights extending generally parallel to each other, and generally vertically. At least first and second side brackets each having first and second ends, at least one mounting ear extending from each first end, and at least one rod-receiving opening at each of the first and second ends of each of the side brackets. A discrete flexible file folder having first and second ends, each of the first and second ends having a rod-connection element. And, first and second rods, each rod having first and second ends dimensioned to fit within one of the rod receiving openings. The first rod operatively connected to the file folder first end rod-connection element and between the rod-receiving openings at the first ends of the side brackets, and the second rod operatively connected to the file folder second end rod-connection element and between the rod-receiving openings at the second ends of the side brackets, while the side brackets ears are received within slots of slotted shelving uprights.

Each side bracket preferably comprises at least two ears associated therewith, the ears being hooked shaped and spaced from each other substantially the same distance as slots are spaced on the slotted shelving uprights. A lock projection is mounted adjacent the ears for cooperating with the ears and slots in the slotted shelving uprights to at least partially lock the side brackets and slotted shelving uprights, providing a "snap-in" action to eliminate accidental removal of the individual side brackets, but to allow ready removal when it is desired to remove them.

Each of the rod receiving openings may include compressible ridges to tightly grip a rod inserted therein, and to accommodate rods of slightly different cross-sectional shapes and dimensions. The rods are typically substantially circular in cross-section and made of mild steel which is galvanized to prevent rust. The rod receiving opening at the first end of each of the side brackets is disposed above a rod receiving opening at the second end of each of the side brackets when mounted by the shelving uprights.

The file folder may be made of a wide variety of suitable flexible materials, including printable materials. Some materials include vinyl sheets, Tyvek®, heavy paper, or cloth; however the preferred materials are polypropylene or polyvinyl chloride sheet material, preferably transparent. The sheet material is preferably creasable at a lower portion thereof when mounted by the rods either by scoring using heat or a bending press. The crease prevents stored papers from rising up the back side of the file folder. Each flexible file folder has first and second ends with each of the first and second ends having a rod-connection element, such as a collar formed by the material forming the file folder, the collar formed by looping over the end of the sheet material forming the flexible file folder and stapling it, heat sealing it, or otherwise attaching it in place.

A top cap and office partition hook may be mounted to each of the shelving uprights for mounting the uprights on an office partition. The hook associated with the top cap may comprise a straight metal member having a plurality of grooves formed therein about which the member is foldable to fit over an office partition, and will remain in a folded-over position.

Any number of side brackets with associated rods and file folders may be mounted in the slotted shelving uprights, and the side brackets may be positioned at any desired positions along the slotted shelving uprights. The individual pockets may be readily removed, the contents thereof worked with, and then replaced, or repositioned at a different location. The number and positioning of the side brackets also determines how many documents each of the file folders can accommodate.

According to another aspect of the present invention a kit for constructing a file folder assembly is provided. The kit comprises the following elements: First and second slotted shelving uprights extending generally parallel to each other. At least four side brackets each having first and second ends, at least one mounting ear extending from each first end, and at least one rod-receiving opening at each of the first and second ends of each of the side brackets. A plurality of discrete flexible file folders each having first and second ends, each of the first and second ends having a rod-receiving collar. And, a plurality of rods, each rod having first and second ends dimensioned to fit within one of the rod-receiving openings, and having a cross-sectional shape and dimension for fitting within one of the rod-receiving collars. The details of all of the components of the kit are preferably as described above with respect to the first aspect of the invention.

According to yet another aspect of the invention a file folder assembly is provided comprising: First and second slotted shelving uprights extending generally parallel to each other, and generally vertically. A plurality of side brackets each having first and second ends, at least one mounting ear extending from each first end, and at least one rod-receiving opening at each of the first and second ends of each of the side brackets. A plurality of flexible file folder having first and second ends, each of the first and second ends having a rod-connection element. A plurality of rods, each rod having first and second ends dimensioned to fit within one of the rod-receiving openings. And, each of the rods operatively connected to an end of the file folder end rod-connection element and between two of the rod-receiving openings at the first or second ends, respectively, of the side brackets, while the side brackets ears are received within slots of the slotted shelving uprights.

It is the primary object of the present invention to provide a relatively inexpensive, versatile, and adjustable file folder assembly, and a kit for construction thereof. This and other objects of the invention will become clear from an inspection of the detailed description of the invention and from the appended claims.

BRIEF DESCRIPTION OF THE DRAWINGS

FIG. 2 is an exploded detail perspective view showing a part of one end of the file folder assembly of FIG. 1 and in particular showing the details of the slotted upright, side bracket, file folder, and mounting rods;

FIG. 3 is a top/rear perspective view of a slightly modified form of a side bracket of FIGS. 1 and 2;

FIG. 7 is a side exploded view showing a top cap and hook associated with a slotted upright according to the present invention;

FIG. 8 a top perspective view of the hook element per se of the apparatus of FIG. 7, before bent about a slot therein; and FIG. 9 is a view like that of FIG. 8 of the top cap assembly of FIG. 7 prior to bending about the hook element.

DETAILED DESCRIPTION OF THE DRAWINGS

Figure 1:
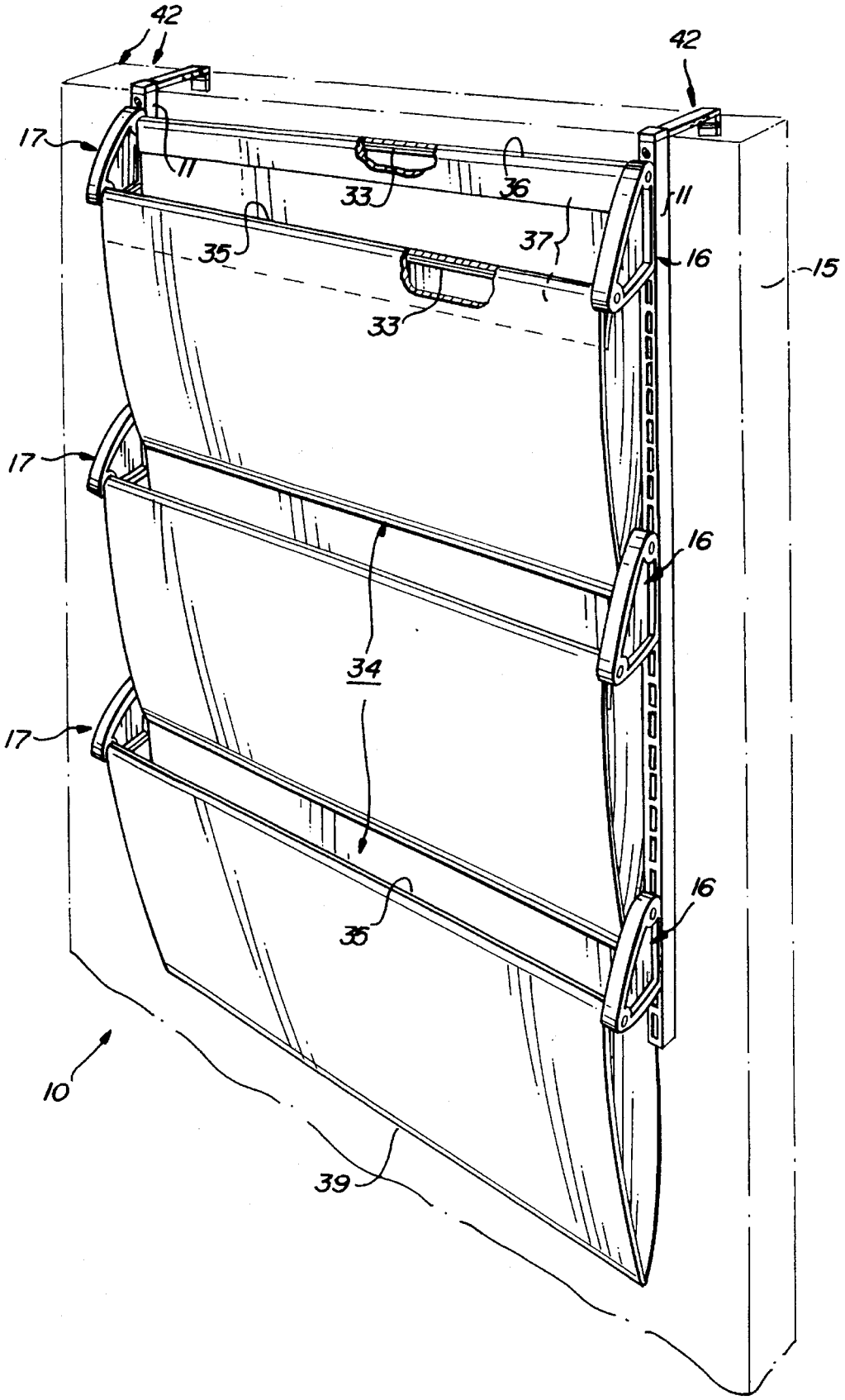
FIG. 1 is a top perspective view showing an exemplary file folder assembly according to the present invention, mounted over an office partition.

An exemplary file folder assembly according to the present invention is shown generally by reference numeral 10 in FIG. 1. The assembly 10 includes first and second slotted shelving uprights 11 extending generally parallel to each other and in use—as illustrated in FIG. 1—extending generally vertically. The slotted shelving uprights 11 are conventional per se and are preferably formed of a rigid material, such as aluminum, and include— as perhaps most clearly illustrated in FIGS. 2 and 4—a cross face 12 extending perpendicular to a pair of legs 13, so that the uprights 11 have a channel-shaped cross-section, with vertically oriented (that is along the dimension of elongation of the upright 11) slots 14 formed therein. The uprights 11 may be mounted generally vertically in any conventional manner, e.g. by bolting or otherwise attaching them to a solid wall, by mounting them with hooks which are draped over office partitions/panels, such as the office panel illustrated in dotted line at 15 in FIG. 1, or in any other suitable manner.

The assembly 10 also includes at least first and second side brackets 16, 17. Preferably a number of different pairs of side brackets 16, 17 are provided, typically anywhere from three to more than a dozen associated with a single set of shelving uprights 11. Typically two different types of side brackets 16, 17 are provided, one "left handed" and the other "right handed", although they can be made so that rod receiving openings associated therewith are through-extending and therefore only one type of side bracket need be provided.

Figure 4:
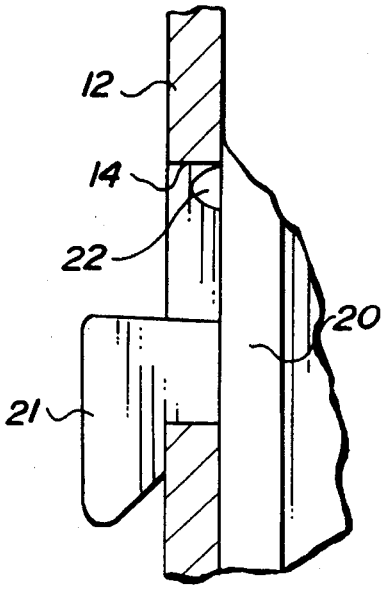
FIG. 4 is a side detail cross-sectional view showing the connection of the ear and locking projection of the side bracket of FIG. 3 in a slotted upright.

An exemplary side bracket 17 is seen in detail in FIG. 2 while the side bracket 16 (modified slightly in form from that actually illustrated in FIG. 1) is seen in FIG. 3. The side brackets 16, 17 are preferably made of ABS plastic, or a like suitable material, and are rigid, having at least one, and preferably two (or more) hook-shaped ears 21 associated therewith. The ears 21 are so spaced from each other substantially the same distance as the slots 14 are spaced along the uprights 11. Also a lock projection 22 (see FIG. 3) is preferably associated with each ear 21, cooperating with the ear 21 in a slot 14 as seen in FIG. 4 to positively hold the brackets 16, 17 in place, providing a "snap-in" action which positively holds, yet allows ready removability of the brackets 16, 17.

Each bracket 16, 17 includes a first end, for example defined by the cross-piece 20 from which the ears 21 and projections 22 extend, and a second end 19 remote from the first end. At the first end 20 a shaped integral piece, for example having a general configuration of a collar, 25 may be provided located at the "top" of the bracket 16 as it will be used in the slots 14, while a similar collar or enlarged structure 24 is provided at the opposite end 19, and below the element 25. A rigid body element 26 connects the ends 19, 20, the connecting element 26 having any desired configuration which incorporates both aesthetics and functionality, as illustrated in FIGS. 2 and 3 for example.

Figure 5:
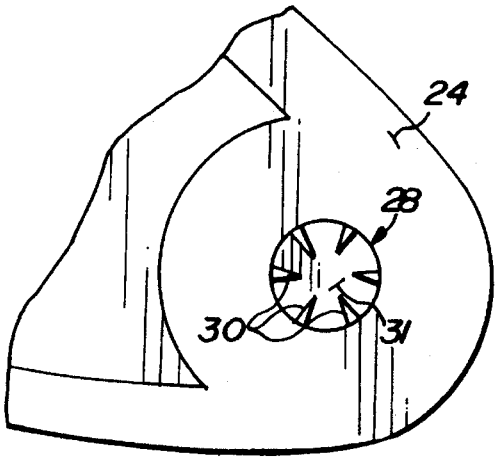
FIG. 5 is an enlarged front view of the rod receiving opening of the side bracket of FIG. 3.
Figure 6:
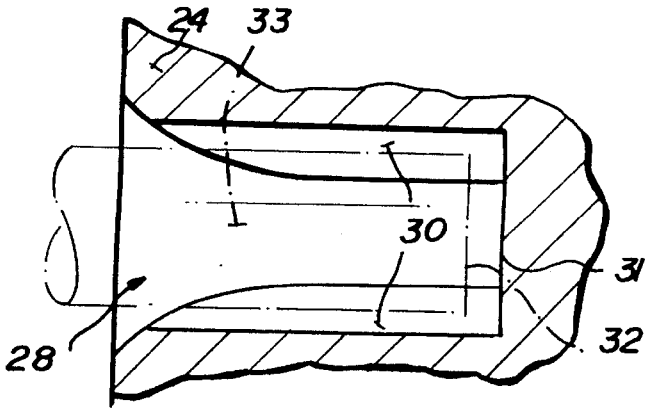
FIG. 6 is a side view, partly in cross-section and partly in elevation, of the opening of FIG. 5.

The first end 19 element 24 has a first rod-receiving opening 28 therein, while the second end 20 element 25 has a second rod-receiving opening 29 therein. While the openings 28, 29 may be through-extending, especially if the side brackets 16, 17 are to have the same construction, it is preferred that they have a closed end wall as seen at 31 in FIG. 6. One particular form that the opening 28, 29 can take is illustrated in FIGS. 5 and 6, the opening 28, 29 being substantially round in cross-section and having a plurality of integral ridges 30 associated therewith. The ridges 30 are also plastic material, and typically somewhat flexible, deforming to receive a rod therein and make an interference or friction fit with the rod to grasp it in place. FIG. 6 illustrates in dotted line the end 32 of a rod 33 positioned in the opening 28 and held tightly in place therein. The provisions of the ridges 30, or like deformable, slanted, or otherwise constructed elements, tightly grip the rod inserted therein and accommodate rods of slightly different cross-sectional shapes and dimensions.

FIGS. 1 and 2 more clearly illustrate exemplary rods 33, having ends 32, that may be utilized. While the rods 33 may be made of a wide variety of material, preferably they are of mild steel galvanized to prevent rust, and are generally circular in cross-section, or although oval or polygonal cross-sections also are suitable.

A significant element of the file folder assembly 10 according to the present invention is the discrete (that is unconnected to other file folders) flexible file folder 34 having first and second ends 35, 36 (see FIG. 2 in particular). The ends 35, 36 have rod-connection elements. While the rod connection elements may be of a wide variety of different constructions, from plastic or metal clips, to is interrupted spaced "piano-hinge" type collars, to an assortment of other constructions, it is preferred that they merely be substantially continuous simple collars 37 as illustrated in FIG. 2. The collars 37 are formed merely by folding over the ends of the folder 34 and affixing the folded over ends to the body of folder 34 to form the collar 37. The fixing may be accomplished, depending upon the particular material of which the file folder 34 is constructed, by a heat seal 38 (see FIG. 2), staples, adhesive, or a wide variety of other conventional connecting components for connecting an end to a body of a piece of sheet material.

The material forming the flexible file folder 34 may be of a wide variety of different types. For example it may be cloth, vinyl sheet, Tyvek®, heavy paper, or the like. However in the preferred embodiment the material is polypropylene or polyvinyl chloride sheet material. Such sheet material can be transparent, colored, or opaque, although transparent material is preferred so that the interior of the file folder 34 can be viewed from the outside. Polypropylene is particularly desirable since it can be easily extruded to the desired sheet thickness that gives optimum bend/flex qualities. Also many of these types of materials, particularly polypropylene and PVC, can be creased by scoring using a heat or a bending press. The crease 39— see FIG. 1—is preferably provided at the lowermost portion of the material forming the folder 34 (taking into account that the end 36 will be slightly higher than the end 35 during use). The crease 39 prevents stored papers from rising up the back side of the folder during use, as illustrated in FIG. 1.

The particular end cap and hook arrangement, shown generally by reference numeral 42 in FIGS. 7 and 1, may be provided for mounting the uprights 11 on an office panel 15. The end cap 42, which is shown in unassembled form in FIG. 9 and in assembled form in FIG. 7, includes a main body portion 45 and first and second extension elements 46, 47 connected together by a living hinge 49. The element 46 has an opening 50 therein while the element 47 has an integral "nut" 51 associated therewith. When the elements 46, 47 are folded about the protrusion 54 of the hook element 43—as seen in FIG. 7—and the screw threaded fastener 52 is passed through the opening 50 into threaded engagement with the nut 51, the end cap 42 is held in place as illustrated in FIG. 7. Preferably the entire end cap 42 is made of ABS plastic. The end cap 42 then fits downwardly into the channel formed by the upright 11, typically being held in place therein by friction, or by the fastener 52 passing through one of the slots 14 (or a predefined opening for that purpose) in addition to passing through the opening 50 before being threaded into contact with the integral nut 51.

The integral nut 51 fits in the opening 53 formed in the protrusion 54 of the element 43. Also, as illustrated in FIG. 8, between the protrusion 54 and the end 56 the structure 43 may be scored, as indicated by score lines 57, which facilitate bending about each score line. The element 43 preferably also is galvinized mild steel or the like, so that it will remain in a position to which it is bent (e.g., see FIG. 7). That is, once the structure 43 is bent about one of the score lines 57—to the solid line position illustrated in FIG. 7—it remains in that position, and hooks over the office partition 15 holding the entire upright 11 to which it is connected in place. By providing a number of score lines 57 the effective length of the hook provided by the element 53 from the protrusion 54 may be adjusted, for example from about one and a half inches to about three and a half inches, to accommodate panels 15 of different widths.

It will be seen that the assembly 10 according to the present invention is easy to construct, that it is easy to mount the side brackets 16, 17 in place and to remove them and with them the contents of the entire file folders 34, and that the number of file folders 34 mounted in association with any set of uprights 11 may be anywhere from one to a dozen or more. It is preferred that a plurality of each of the side brackets 16, 17, at least two slotted shelving uprights 11, a plurality of discrete flexible file folders (e.g. at least two, preferably at least three) and a plurality of rods 33 (at least four and preferably at least six) may be provided within a kit which can be sold for easy installation. The file folder assembly 10 according to the present invention has maximum adjustability, expandability, and functionality. While the invention has been herein shown and described in what is presently conceived to be the most practical and preferred embodiment thereof it will be apparent to those of ordinary skill in the art that many modifications may be made thereof within the scope of the invention, which scope is to be accorded the broadest interpretation of the appended claims so as to encompass all equivalent structures and devices.

What is claimed is:

1. A file folder assembly, comprising:

first and second slotted shelving uprights extending generally parallel to each other, and generally vertically;

at least first and second side brackets each having first and second ends, at least one mounting ear extending from each first end, and at least one rod-receiving opening at each of said first and second ends of each of said side brackets;

a discrete flexible file folder having first and second ends, each of said first and second ends having a rod-connection element; and first and second rods, each rod having first and second ends dimensioned to fit within one of said rod-receiving openings;

said first rod operatively connected to said file folder first end rod-connection element and between said rod-receiving openings at said first ends of said side brackets, and said second rod operatively connected to said file folder second end rod-connection element and between said rod-receiving openings at said second ends of said side brackets, while said side brackets ears are received within slots of said slotted shelving uprights.

2. A file folder assembly as recited in claim 1 wherein said at least one ear associated with each side bracket comprises at least two ears associated with each side bracket.

3. A file folder assembly as recited in claim 2 wherein each of said ears is hooked shaped and spaced from each other substantially the same distance as slots are spaced in said slotted shelving uprights.

4. A file folder assembly as recited in claim 3 further comprising a lock projection mounted adjacent said ears for cooperating with said ears and slots in said slotted shelving uprights to at least partially lock said side brackets in said slotted shelving uprights.

5. A file folder assembly as recited in claim 1 wherein each of said rod receiving openings includes compressible ridges formed therein to tightly grip a rod inserted therein, and to accommodate rods of slightly different cross-sectional shapes and dimensions.

6. A file folder assembly as recited in claim 1 comprising a plurality of other first and second side brackets and a plurality of other first and second rods, and a plurality of other discrete file folders, each first rod operatively connected to a file folder first end and between rod-receiving openings of said side brackets, and each second rod operatively connected to a file folder second end and between two of said side brackets, and wherein the ears of each of said side brackets are received within slots of said slotted shelving uprights.

7. A file folder assembly as recited in claim 1 wherein said file folder is of transparent polypropylene or polyvinyl chloride sheet material.

8. A file folder assembly as recited in claim 7 wherein said file folder sheet material is creased at a lower portion thereof when mounted by said rods, so as to prevent papers disposed in said file folder from rising up the sides of said file folder.

9. A file folder assembly as recited in claim 1 wherein said rod receiving opening at said first end of each of said side brackets is disposed above said rod receiving opening at said second end of each of said side brackets when mounted by said shelving uprights.

10. A file folder assembly as recited in claim 1 wherein said rods are substantially circular in cross-section and are made of mild steel which is galvanized to prevent rust.

11. A file folder assembly as recited in claim 1 further comprising a top cap and office-partition hook mounted to each of said shelving uprights for mounting said shelving uprights on an office-partition.

12. A file folder assembly as recited in claim 11 wherein said hook associated with said top cap comprises a straight metal member having a plurality of grooves formed therein about which said member is foldable to fit over an office-partition.

13. A file folder assembly as recited in claim 11 wherein said hook associated with said top cap comprises a plastic member having first and second portions with a living hinge therebetween.

14. A file folder assembly as recited in claim 1 wherein each said rod-connection element comprises a collar formed by the material forming said file folder.

15. A kit for constructing a file folder assembly, comprising:

first and second slotted shelving uprights extending generally parallel to each other;

at least four side brackets each having first and second ends, at least one mounting ear extending from each first end, and at least one rod-receiving opening at each of said first and second ends of each of said side brackets;

a plurality of discrete flexible file folders each having first and second ends, each of said first and second ends having a rod-receiving collar; and a plurality of rods, each rod having first and second ends dimensioned to fit within one of said rod-receiving openings, and having a cross-sectional shape and dimension for fitting within one of said rod-receiving collars.

16. A kit as recited in claim 15 wherein said at least one ear associated with each side bracket comprises at least two hook-shaped ears associated with each side bracket and spaced from each other substantially the same distance as slots are spaced in said slotted shelving uprights, and further comprising a lock projection mounted adjacent said ears for cooperating with said ears and slots in said slotted shelving uprights to at least partially lock said side brackets in said slotted shelving uprights.

17. A kit as recited in claim 15 wherein each of said rod receiving openings includes compressible ridges formed therein to tightly grip a rod inserted therein, and to accommodate rods of slightly different cross-sectional shapes and dimensions.

18. A kit as recited in claim 15 wherein each of said file folders is constructed of sheet material which is creased at a lower portion thereof when mounted by said rods, so as to prevent papers disposed in said file folder from rising up the sides of said file folder.

19. A file folder assembly, comprising:

first and second slotted shelving uprights extending generally parallel to each other, and generally vertically;

a plurality of side brackets each having first and second ends, at least one mounting ear extending from each first end, and at least one rod-receiving opening at each of said first and second ends of each of said side brackets;

a plurality of flexible file folders having first and second ends, each of said first and second ends having a rod-connection element;

a plurality of rods, each rod having first and second ends dimensioned to fit within one of said rod-receiving openings; and each of said rods operatively connected to an end of said file folder end rod-connection element and between two of said rod-receiving openings at said first or second ends, respectively, of said side brackets, while said side brackets ears are received within slots of said slotted shelving uprights.

20. A file folder assembly as recited in claim 19 wherein said at least one ear associated with each side bracket comprises at least two hooked-shaped ears associated with each side bracket spaced from each other substantially the same distance as slots are spaced in said slotted shelving uprights, and further comprising a lock projection mounted adjacent said ears for cooperating with said ears and slots in said slotted shelving uprights to at least partially lock said side brackets in said slotted shelving uprights.

* * * * *